United States Patent [19]

Sheaffer

[11] Patent Number: 4,481,910

[45] Date of Patent: Nov. 13, 1984

[54] STRATIFIED-CHARGE TWO-STROKE CYCLE ENGINE

[75] Inventor: Benjamin L. Sheaffer, Oshkosh, Wis.

[73] Assignee: Brunswick Corporation, Skokie, Ill.

[21] Appl. No.: 566,493

[22] Filed: Dec. 29, 1983

[51] Int. Cl.[3] ..... F02B 33/04; F24B 13/04

[52] U.S. Cl. ..... 123/73 R; 123/73 A; 123/73 B; 123/DIG. 4; 123/432; 123/433

[58] Field of Search ..... 123/73 R, 73 A, 73 B, 123/DIG. 4, 433, 432, 575, 585, 59 B

[56] References Cited

U.S. PATENT DOCUMENTS

| | | | |
|---|---|---|---|
| 1,664,091 | 3/1928 | Sinclair | 123/DIG. 4 |
| 1,947,375 | 2/1934 | Broderson | 123/DIG. 4 |
| 2,249,354 | 7/1971 | Gehres | 123/DIG. 4 |
| 4,075,985 | 2/1978 | Iwai . | |
| 4,253,433 | 3/1981 | Blair . | |
| 4,317,432 | 3/1982 | Noguchi et al. | 123/432 X |

FOREIGN PATENT DOCUMENTS

| | | | |
|---|---|---|---|
| 2347809 | 4/1975 | Fed. Rep. of Germany | 123/DIG. 4 |
| 2756794 | 6/1978 | Fed. Rep. of Germany | 123/DIG. 4 |

OTHER PUBLICATIONS

"Zweitakt-Gemischspülung mit Spülvorlage", by Dr.-Ing. Kurt Blume, Galβach, *MTZ Motortechnische Zeitschrift,* 74, (1972), pp. 475-479.

*Primary Examiner*—Wendell E. Burns

*Attorney, Agent, or Firm*—Andrus, Sceales, Starke & Sawall

[57] ABSTRACT

A stratified-charge two-stroke cycle scavenged spark-ignition engine 1 includes a piston (2) reciprocal in a cylinder (3) between a combustion chamber 4 and a crankcase (5). A carburetor (17) is mounted to the crankcase substantially coaxially with the piston to afford narrow engine design. An elongated scavenging air passage (14) extends between the crankcase and the combustion chamber and has a length substantially greater than that of a fuel-air transfer passage (7), and the height of piston (2), to reduce fuel mixture in the scavenging air passage and afford substantially only air at an air inlet port (16), which port is between fuel-air mixture inlet port (8) and exhaust port (13).

10 Claims, 2 Drawing Figures

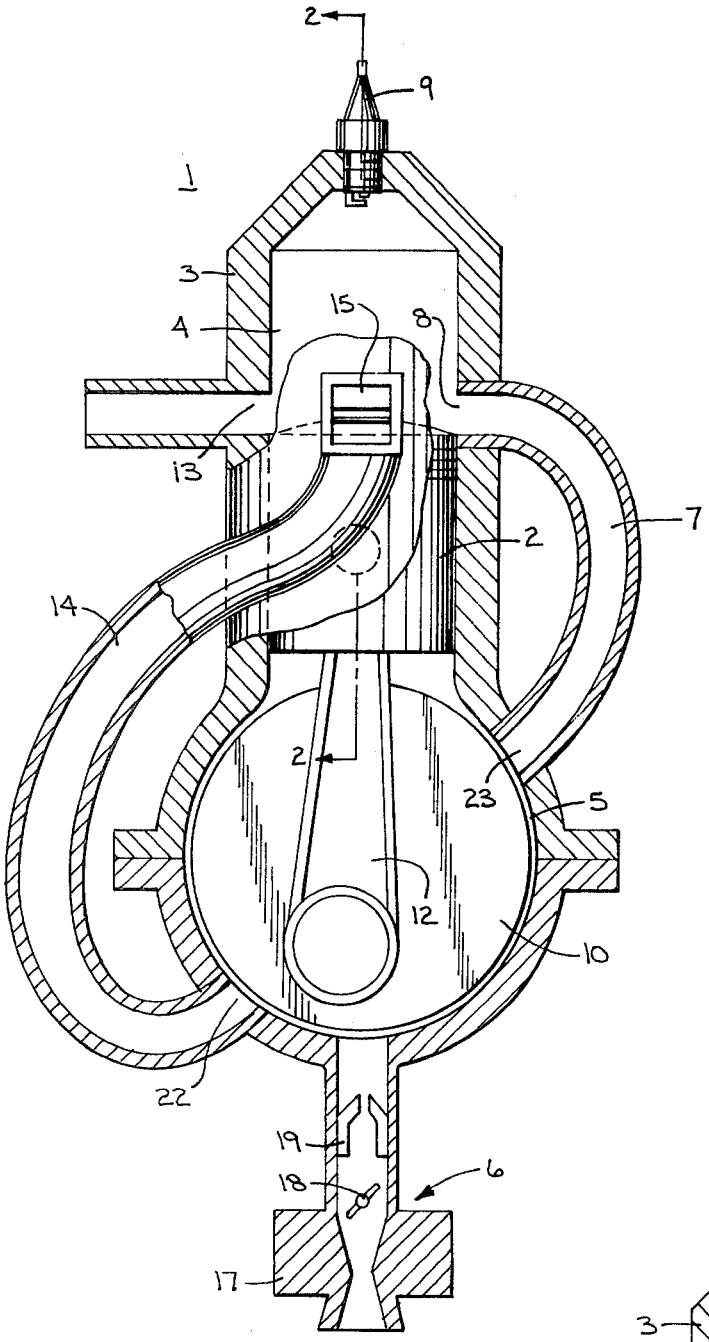
FIG. 1
FIG. 2
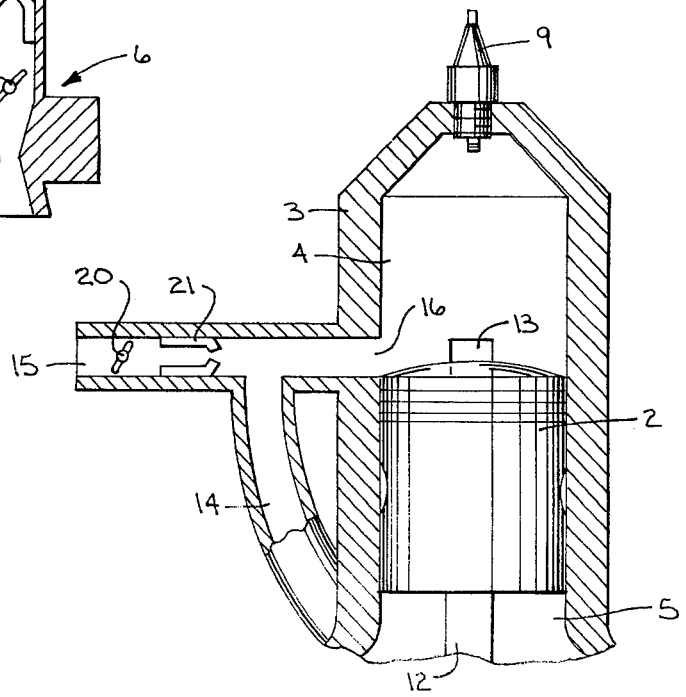

STRATIFIED-CHARGE TWO-STROKE CYCLE ENGINE

DESCRIPTION

1. Technical Field

The invention relates to a stratified-charge two-stroke cycle scavenged spark-ignition engine. One application is marine propulsion systems.

2. Background

In two-stroke cycle engines, it is desirable to scavenge the combustion chamber during the downward stroke of the piston and expel combustion gas with minimal loss of unburned fuel-air mixture admitted for the next cycle. One way of enhancing scavenging is to provide an auxiliary air port in the cylinder to supply scavenging air during the downstroke of the piston.

DISCLOSURE OF THE INVENTION

A two-stroke cycle engine of reduced fuel consumption is provided, well suited to low cost, low horsepower engine applications, particularly those implementations requiring narrow engine design. An elongated scavenging air passage between the crankcase and the combustion chamber has a length great enough to reduce fuel mixture therein. Fuel is supplied to the crankcase, and a substantially shorter fuel-air transfer passage extends between the crankcase and the combustion chamber.

BRIEF DESCRIPTION OF THE DRAWINGS

FIG. 1 is a schematic partial sectional view of a two-stoke cycle engine constructed in accordance with the invention.

FIG. 2 is a cross sectional view taken along line 2—2 of FIG. 1.

BEST MODE FOR CARRYING OUT THE INVENTION

A stratified-charged two-stroke cycle scavenged spark-ignition engine 1, includes a piston 2 reciprocal in a cylinder 3 between a combustion chamber 4 and a crankcase 5. A supply system 6 is provided for supplying fuel into crankcase 5. A fuel-air transfer passage 7 extends between crankcase 5 and a fuel-air inlet port 8 in combustion chamber 4. During the upstroke of piston 2, the fuel-air mixture is compressed in chamber 4, and upon ignition of spark plug 9 combustion of the mixture drives piston 2 downwardly to rotate crankshaft 10 through connecting rod 12. The combustion products exit through port 13.

An elongated scavenging air passage 14 has an input 15 for receiving external air. Elongated air passage 14 extends between crankcase 5 and an air inlet port 16 in combustion chamber 4. Fuel-air inlet port 8 is approximately 180° opposite exhaust port 13. The air inlet port 16 is located between the exhaust port 13 and the fuel-air inlet port 8. The greater the length of passage 14 between crankcase 5 and combustion chamber 4 the lesser the amount of fuel and the greater the amount of air at port 16. There is thus a reduction in the amount of unburned fuel mixture from port 16 otherwise lost to exhaustion, and furthermore, there is increased substitution of air to reduce the amount of unburned fuel mixture from port 8 otherwise lost to exhaustion. Fuel consumption is reduced by substantially reducing exhaustion of unburned fuel mixture. Passage 14 has a length great enough to reduce fuel mixture therein and afford substantially only air at air inlet port 16 to substitute air for exhaustion at exhaust port 13 instead of otherwise exhausted unburned fuel-air mixture from inlet port 8.

The fuel supply system 6 includes carburetor 17, having a butterfly valve 18 and a one-way reed valve 19, mounted to crankcase 5 substantially coaxially with piston 2 to enable a narrow engine design. By supplying the fuel into the crankcase, there is better mixing of fuel and air because the fuel goes into a hot crankcase and is stirred up by the crankshaft and connecting rods to provide better atomization and vaporization. Furthermore, no lubrication pump is required because the carburetor is mounted on the crankcase and supplies the fuel-oil mixture.

Air passage input port 15 may be provided by a throttle body, including butterfly valve 20 and one-way reed valve 21, which throttle body is shorter than a carburetor otherwise mounted on side transfer passage 7 and can be mounted closer to the engine since there is no carburetor spit back of fuel.

Elongated air passage 14 has a length between crankcase 5 at input port 22 and air inlet port 16 substantially greater than that of fuel-air passage 7. Passage 7 extends from crankcase 5 at a port 23 adjacent piston 2 and has a length approximately equal to the height of piston 2, whereas elongated air passage 14 has a length substantially greater than the height of piston 2. Passage 14 extends from crankcase 5 at a point 22 distally removed from the piston, and has a length preferably at least 1.5 times greater than the height of the piston.

I claim:

1. A stratified-charge two-stroke cycle scavenged spark-ignition engine comprising a piston reciprocal in a cylinder between a combustion chamber and a crankcase, means for supplying fuel into said crankcase, a fuel-air transfer passage between said crankcase and a fuel-air inlet port in said combustion chamber, an exhaust port in said combustion chamber, and an elongated air passage having an input for receiving external air and extending between said crankcase and an air inlet port in said combustion chamber and of a length great enough to reduce fuel mixture therein and afford substantially only air at said air inlet port to substitute air for exhaustion at said exhaust port instead of otherwise unburned fuel mixture from said fuel-air inlet port, to reduce fuel consumption by substantially reducing exhaustion of unburned fuel mixture.

2. The invention according to claim 1 wherein said fuel-air inlet port is located approximately 180° opposite to said exhaust port, and said air inlet port is between said exhaust port and said fuel-air inlet port.

3. The invention according to claim 1 wherein said fuel supplying means comprises carburetor means mounted to said crankcase substantially coaxially with said piston to enable narrow engine design.

4. A stratified-charge two-stroke scavenged spark-ignition engine comprising a piston reciprocal in a cylinder between a combustion chamber and a crankcase, means for supplying fuel into said crankcase, a fuel-air transfer passage between said crankcase and a fuel-air inlet port in said combustion chamber, an exhaust port in said combustion chamber, an elongated air passage having an input for receiving external air and extending between said crankcase and an air inlet port in said combustion chamber and having a length therebetween substantially greater than that of said fuel-air passage.

5. The invention according to claim 4 wherein the length of said elongated air passage is substantially greater than the height of said piston.

6. The invention according to claim 4 wherein said elongated air passage communicates with said crankcase at a point distally removed from said piston.

7. The invention according to claim 4 wherein said fuel-air transfer passage extends from said crankcase at a point adjacent said piston and has a length approximately equal to the height of said piston, and said elongated air passage extends from said crankcase at a point distally removed from said piston and has a length substantially greater than the height of said piston.

8. The invention according to claim 7 wherein said length of said elongated air passage between said crankcase and said air inlet port in said combustion chamber is at least 1.5 times greater than said height of said piston.

9. The invention according to claim 7 wherein said fuel-air inlet port is approximately 180° opposite said exhaust port, and said air inlet port is between said exhaust port and said fuel-air inlet port.

10. A stratified-charge two-stroke cycle scavenged spark-ignition engine comprising a piston reciprocal in a cylinder between a combustion chamber and a crankcase, carburetor means mounted to said crankcase substantially coaxially with said piston for supplying fuel into said crankcase, an exhaust port in said combustion chamber, a fuel-air transfer passage extending between said crankcase at a point adjacent said piston and a fuel-air inlet port in said combustion chamber approximately 180° opposite said exhaust port and having a length approximately equal to the height of said piston, and an elongated air passage having an input for receiving external air and extending between said crankcase at a point distally removed from said piston and an air inlet port in said combustion chamber between said exhaust port and said fuel-air inlet port, said elongated air passage having a length between said crankcase and said combustion chamber substantially greater than the height of said piston.

* * * * *